US006186109B1

(12) United States Patent
Matsuno

(10) Patent No.: US 6,186,109 B1
(45) Date of Patent: Feb. 13, 2001

(54) ENGINE CONSTRUCTION

(75) Inventor: Yasuyuki Matsuno, Iwata (JP)

(73) Assignee: Yamaha Hatsudoki Kabushiki Kaisha, Iwata (JP)

( * ) Notice: Under 35 U.S.C. 154(b), the term of this patent shall be extended for 0 days.

(21) Appl. No.: 09/441,274

(22) Filed: Nov. 16, 1999

(51) Int. Cl.[7] ..... F02B 75/06; F02B 77/14
(52) U.S. Cl. ..... 123/192.1; 123/198 R
(58) Field of Search ..... 123/192.1, 192.2, 123/198 R, 198 C, 195 R

(56) References Cited

U.S. PATENT DOCUMENTS 4,573,439 * 3/1986 Kasting ..... 123/195 A
4,753,199 * 6/1988 Melde-Tuczai et al. ..... 123/90.31
5,715,784 * 2/1998 Okui et al. ..... 123/192.2

* cited by examiner

*Primary Examiner*—Andrew M. Dolinar
*Assistant Examiner*—Hai Huynh
(74) *Attorney, Agent, or Firm*—Knobbe, Martens, Olson & Bear LLP

(57) ABSTRACT

An improved and compact accessory drive for an engine that facilitates transverse positioning in an engine compartment. One end of the engine crankshaft extends through an outer face of the engine body. A torsional damper is affixed to this crankshaft end. An accessory drive pulley is driven by a shaft that is juxtaposed to this end of the crankshaft and which is disposed axially from the torsional damper. Adjacent surfaces of the torsional damper and accessory drive pulley have mating tapered surfaces so that these elements overlap both axially and radially. A drive belt drives a plurality of engine accessories from this drive pulley so as to maintain case of access to the drive belt while maintaining a compact overall length.

8 Claims, 4 Drawing Sheets

ENGINE CONSTRUCTION

BACKGROUND OF THE INVENTION

This invention relates to an engine construction and more particularly to an improved and compact engine accessory drive for an engine.

There is a continuing demand for more compact engine construction, particularly for motor vehicle applications. That is, the space which is available for the engine continues to diminish, while, at the same time, the demands on the engine for more power and output and the ability to drive more accessories continues to increase. A number of these problems arc exacerbated by the transverse placement of engines in many automotive applications in the engine compartment.

Generally, the engine is called upon to drive a number of accessories, including such things as power steering pumps, air conditioning compressors, as well as other accessories that are not primarily required for the engine operation. Generally, these accessories are driven by means of flexible pulley drives that arc disposed externally of the engine and at generally at the ends of the engine. However, with transverse engine placement, the space available at the ends of the engine continues to diminish, particularly as the number of cylinders of the engine increases.

These problems are even more prevalent when the engine is provided with one or more overhead camshafts. The camshafts arc generally driven by a timing drive which may be located at or near one end of the engine and somewhat adds to its overall length. This tends to push the exposed ends of the engine output shafts that are available for accessory drive even further outwardly from the engine.

It is, therefore, a principal object of this invention to provide an improved accessory drive arrangement for an internal combustion engine.

It is a further object of this invention to provide an improved and compact accessory drive for an engine wherein the accessory drive can be located at but inwardly of one end of the engine to provide a more compact assembly.

It is a further object of this invention to provide an improved accessory drive for an engine that provides a compact assembly in which the driving belt for a plurality of accessories can be disposed at one end of but inwardly from a torsional damper or other similar manner affixed to the end of the crankshaft at that end of the engine.

SUMMARY OF THE INVENTION

This invention is adapted to be embodied in an internal combustion engine having an engine body in which a crankshaft is supported for rotation about a longitudinally extending axis. One end of the crankshaft extends outwardly from one end of the engine body and has a torsional damper affixed thereto. An accessory drive shaft is driven by the engine crankshaft and also has an end that it is disposed adjacent the one end of the engine. An accessory drive pulley is affixed to this end of the accessory drive shall and is disposed axially inwardly from the torsional damper. The diameter of the torsional damper is such, however, that it overlies this drive pulley when viewed in an axial direction so as to provide a compact and yet serviceable assembly.

DETAILED DESCRIPTION OF THE PREFERRED EMBODIMENT OF THE INVENTION

Figure 1:
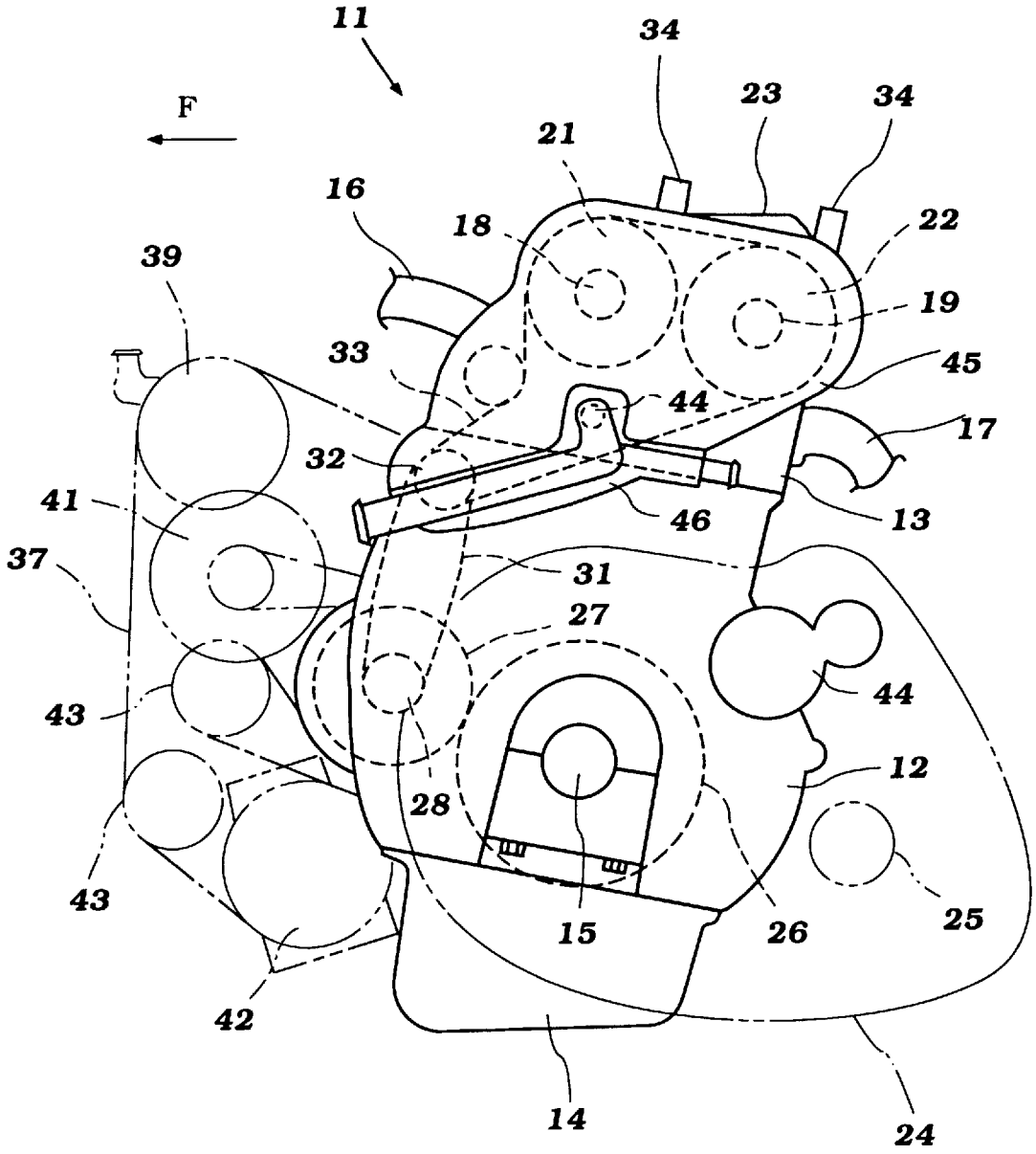
FIG. 1 is an end elevational view of an internal combustion engine constructed in accordance with an embodiment of the invention.
Figure 2:
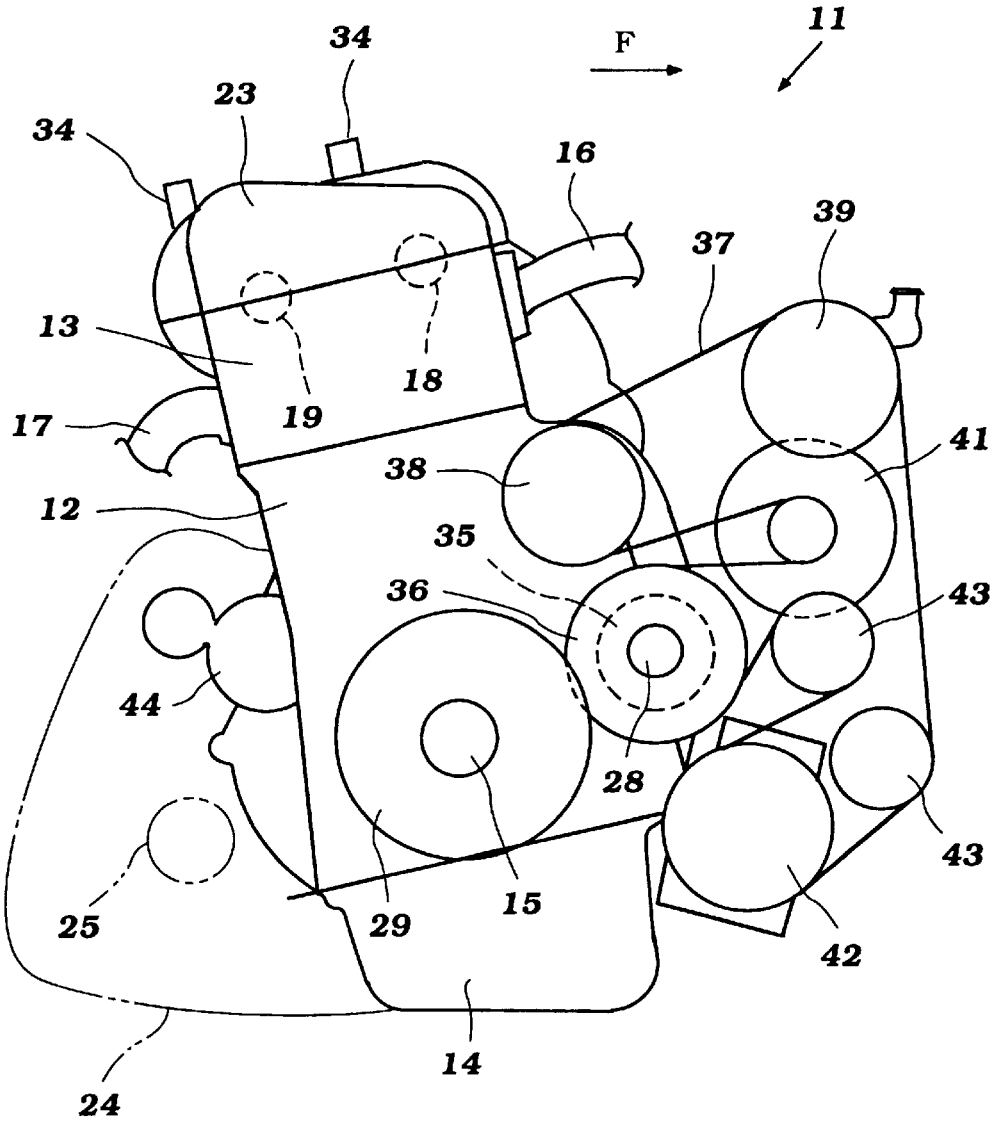
FIG. 2 is an end elevational view showing the opposite end of the engine from that depicted in FIG. 1.

Referring now in detail to the drawings and initially primarily to FIGS. 1 and 2, an internal combustion engine constructed in accordance with an embodiment of the invention is indicated generally by the reference numeral 11. In the illustrated embodiment, the engine 11 is of the inline type and has a number of inline cylinders. The engine 11 is particularly adapted for use in powering the motor vehicle wherein the engine 11 is placed transversely in the engine compartment for driving the vehicle through a suitable final drive to be described later.

The construction of the engine permits this transverse mounting of the engine 11 with the direction of forward motion of the vehicle being indicated by the reference character F. Although such an orientation and such a driving application is exemplary, it will be readily apparent to those skilled in the art the invention can be utilized with a wide variety of types of applications other than motor vehicles and also in motor vehicles applications where the engine 11 is not necessarily positioned transversely in the engine compartment of the vehicle.

Also, the particular number of cylinders and the orientation of them is not necessarily a critical feature of the invention. It will become readily apparent to those skilled in the art that the invention can be utilized with a wide variety of engine configurations.

The engine 11 is made up of an engine body that is comprised of three major external components. These comprise a cylinder block assembly 12, a cylinder head assembly 13 and a crankcase or oil pan member 14. The cylinder block assembly 12 forms one or more inline cylinder bores in which pistons reciprocate. Since the internal details of the engine form no part of the present invention, they are not illustrated. It will be readily apparent, however, how the invention can be employed with a wide variety of engine configurations, as already noted.

The aforenoted pistons reciprocate in the cylinder bores and are connected by connecting rods, which are also not shown, so as to drive a crankshaft 15. The crankshaft 15 rotates about a transversely disposed axis within a crankcase chamber formed by the oil pan 14 and a lower skirt or crankcase forming portion of the cylinder block assembly 12.

The aforenoted pistons and their respective cylinder bores cooperate with recesses formed in the cylinder head 13 so as to form the combustion chambers of the engine. An intake charge is delivered to these combustion chambers through an intake manifold, indicated generally by the reference numeral 16. The delivered intake charge may comprise a pure air charge or an air/fuel charge depending upon the type of charge forming system employed for the engine. Since the charge forming system as well as the porting arrangement associated therewith, like other components which have not been described in detail, forms no part of the invention, it will not be described in further detail. It is believed that those skilled in the art will readily understand how the invention can be utilized with various types of induction and porting systems.

The charge which is delivered to the combustion chambers is fired in an appropriate manner and is then discharged through an exhaust system which includes an exhaust manifold 17 that is affixed to the cylinder head 13 on the side opposite to the intake manifold 16. Again, any suitable type of exhaust system and porting arrangement can be employed with the engine 11 including the exhaust manifold 17.

Intake and exhaust valves are mounted in the cylinder head assembly 13 for controlling the intake and exhaust flow in a generally known manner and are operated by means of a valve actuating mechanism which is comprised of an intake cam shaft 18 and an exhaust cam shaft 19. These cam shafts 18 and 19 are journaled in the cylinder head assembly 13 in any suitable manner and are driven at one half crankshaft speed by a suitable timing drive, to be described shortly.

This timing drive includes a pair of variable valve timing mechanisms, indicated generally by the reference numerals 21 and 22 which may be of any known types so as to vary the phase angle between the intake and exhaust cam shafts 18 and 19 and the engine crankshaft 15. These variable valve timing mechanisms 21 and 22 are operated in a suitable manner.

Finally, the valve actuating mechanism including some of those components already described is covered by means of a cam cover 23 that is affixed to and forms a part of the cylinder head assembly 13 in a suitable member.

The associated vehicle is driven from the engine crankshaft 15 or another output shaft thereof through a transmission which is shown only in phantom and indicated generally by the reference numeral 24. This transmission 24 includes an output shaft 25 which is driven through a suitable transmission which may include a change speed mechanism of either a manual or an automatic type. Again, this component is not an important part of the invention and, for that reason, has not been illustrated in detail.

The mechanism for driving the cam shafts 18 and 19 including the variable valve timing mechanisms 21 and 22 will now be described initially by primary reference to FIGS. 1 and 2. The crankshaft 15 has a timing gear 26 affixed to it at an appropriate position along its length and which may be disposed adjacent one end of the engine such as the end shown in FIG. 1. However, this timing gear 26 need not be disposed at the absolute end of the crankshaft 15 but may be disposed inwardly at one or more throws thereof so as to maintain a short overall length for the engine. This timing gear 26 is enmeshed with a driven timing gear 27 which drives a balancer shaft 28. The balancer shaft 28 can contain one or more balancing masses for partially balancing the crankshaft 15. In addition, a torsional damper 29 is affixed to the one end of the crankshaft 15 specifically the end shown in FIG. 2. This damper 29 has a construction that will be described in more detail later in reference to FIGS. 3 and 4.

In addition to providing a balancer action, the balancer shaft 28 also includes a timing sprocket which drives a first flexible timing drive 31 which may comprise either a toothed belt or a chain. This drives a cam shaft driving shaft 32 which is journaled at an upper portion of the cylinder block 12 at one side thereof in a suitable manner.

The cam driving shaft 32 has a sprocket or toothed member fixed to an appropriate position adjacent one end of the engine (the end shown in FIG. 1) so as to drive a second flexible transmitter drive 33 which comprise either a chain or toothed belt. This flexible transmitter 33 is engaged with appropriate sprockets carried by the variable valve timing mechanisms 21 and 22 so as to drive the cam shafts 18 and 19 at one half of the speed of the crankshaft 15.

It should be noted that the speed reduction can be provided in several and different stages between the crankshaft 15, the balancer shaft 28, the cam driving shaft 32 and the variable valve timing mechanisms 21 and 22. Because of this multistage step-down, the individual sprockets or gears can be maintained with a relatively small diameter to permit a compact engine construction.

The variable valve timing mechanisms 21 and 22 may, as have been noted, be of any known type and are hydraulically actuated so as to vary the valve timing in accordance with any desired control strategy. Control valves 34 are mounted in the cylinder head assembly 13 and specifically adjacent the timing drive for effecting this control. This mechanism may be of any suitable type, for example that shown and described in my copending application entitled, "Variable Valve Timing Arrangement For Engine", Ser. No. 09/426, 241, filed Oct. 25, 1999 and assigned to the assignee hereof.

Figure 3:
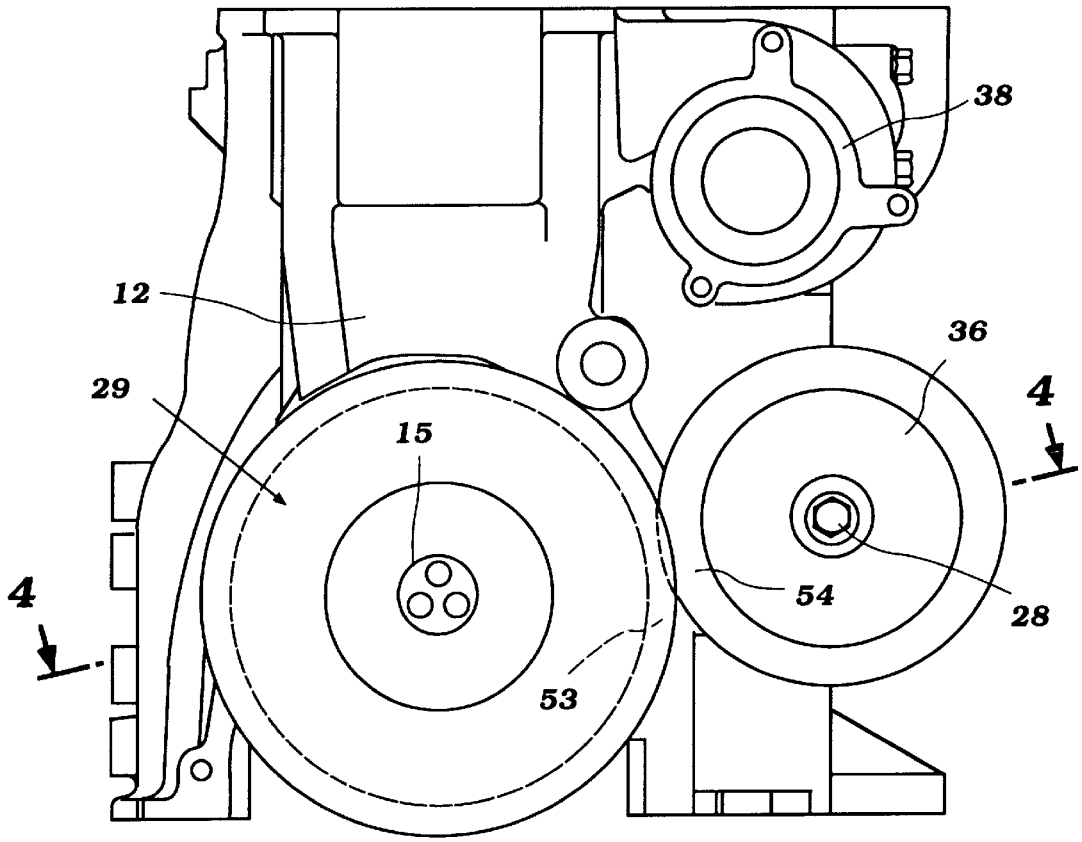
FIG. 3 is a view looking generally in the same direction as FIG. 2 but on an enlarged scale and shows the relation between the torsional damper on the crankshaft, the accessory drive pulley and the oil pump.
Figure 4:
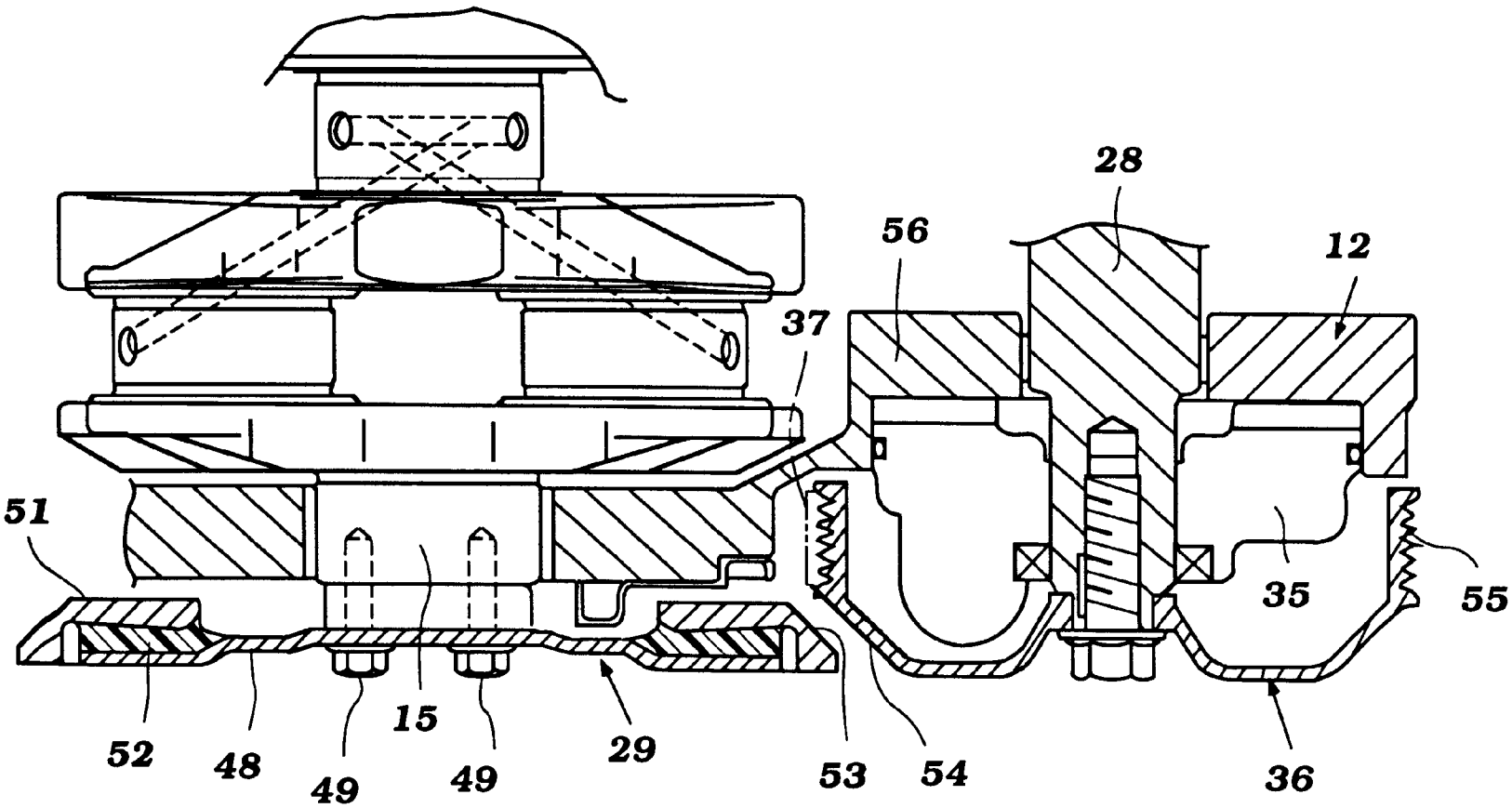
FIG. 4 is a cross sectional view taken along the line 4—4 in FIG. 3.

As may be best seen in FIGS. 2 -4, the balancer shaft 28 extends through one end of the engine and protrudes at the end shown in these figures. At this point, the balancer shaft 28 may drive an oil pump 35 for supplying lubricant from a suitable lubricant system including the oil pan 14 to the various components of the engine as well as the VVT control valves 34 for engine operation. Also affixed to the balancer shaft 28 at this end of the engine, is an accessory drive pulley 36. The details of this drive construction, which embodies the invention, will be described shortly.

This accessory drive pulley 36 drives a flexible transmitter 37 for driving a plurality of engine accessories. These may include, by way of example, a coolant pump 38 for circulating liquid coolant through the cooling jackets of the engine 11, as will be described in part in more detail later. In addition, there are driven a further oil pump 39, such as a power steering pump, an alternator 41, and an air conditioner pulley 42. In order to provide this serpentine drive for the accessories, there are also provided idler pulleys 43 one of which may be adjustable so as to adjust the tension in the drive belt 37.

A starter motor 44 is mounted on a side of the cylinder block and cooperates with a suitable starter gear formed on the crankshaft 15 or a flywheel associated therewith for electrical starting of the engine.

As seen in FIG. 1, the face of the engine and specifically of the cylinder head 13 adjacent the flexible transmitter 33 is formed with the opening 45 via which coolant may be discharged from the engine body and specifically the cylinder block 12 and cylinder head 13 and cooling jackets thereof .

It will be seen that this opening 45 lies in an area circumscribed by the flexible transmitter 33. A cover 46 is provided which is affixed to the cylinder head 13 and valve cover 23 at this end of the engine and which covers basically the variable valve timing drives 21 and 22 and a major portion of the length of the flexible transmitter 33. However, the area overlying the water outlet opening 44 is covered by a coolant manifold member, indicated generally by the reference numeral 47, and which has a face that is directly engaged with the adjacent surface of the cylinder head 13. This construction is described in more detail in my copending application entitled "Engine Coolant Manifold", Ser. No. 09/426,337, filed Oct. 25, 1999 and assigned to the Assignee hereof.

The invention deals primarily with the way in which the pulley 36 is driven from the balancer shaft 28 and its interrelationship with the damper 29 so as to provide a very compact accessory drive and nevertheless one which is located at an end of the engine so that it can be very conveniently and easily serviced. This construction is shown best in and will be described by reference to FIGS. 3 and 4.

First, it should be noted that the torsional damper 15 includes a plate-like end member 48 that is affixed to the exposed end of the crankshaft 15 by means of threaded fasteners 49. This drive member 48 is coupled to an inertial member 51 by an elastomeric disc 52 to provide a torsional damping in a manner well known in the art.

It should be noted that the rear end of the damper member 51 is formed with a beveled edge 53 so as to provide a clearance for a like beveled surface 54 of the pulley 36 which is disposed axially outwardly of the portion 55 which drives the drive belt 37. This permits the pulley and damper to overlap each other in the axial direction, as seen in FIG. 3, while minimizing the axial length, as seen in FIG. 4.

The oil pump 35 is contained within this pulley and specifically the drive portion 53 and a recess formed in an outer wall 56 of this end of the engine. As a result of this construction and as best seen in FIG. 4, this permits the drive pulley 37 to be positioned at this end of the engine but inwardly from the torsional damper 29 and in an area where it will be protected but easily serviced.

Of course, the foregoing description is that of a preferred embodiment of the invention, and various changes and modifications may be made without departing from the spirit and scope of the invention, as defined by the appended claims.

What is claimed is:

1. An internal combustion engine and accessory drive therefore, said engine being comprised of an engine body in which a crankshaft is supported for rotation about a longitudinally extending axis, one end of said crankshaft extending outwardly from one end of said engine body, a torsional damper affixed to said one end of said crankshaft, an accessory drive shaft driven by said engine crankshaft about a parallel, juxtaposed axis, said accessory drive shaft having an end that it is disposed adjacent said one end of said engine, and an accessory drive pulley affixed to said end of said accessory drive shaft and axially spaced from said torsional damper, the diameters of said torsional damper and of said accessory drive pulley being such that they overlap each other when viewed in an axial direction.

2. An internal combustion engine accessory drive as set forth in claim 1, wherein the adjacent surfaces of the torsional damper and the drive pulley are formed with internested beveled edges.

3. An engine accessory drive as set forth in claim 1, wherein an oil pump is nested within the accessory drive pulley and disposed forwardly of an adjacent face of the engine body.

4. An internal combustion engine accessory drive as set forth in claim 1, wherein the torsional damper comprises a drive part rotatably affixed to the crankshaft and an inertial ring elastically coupled to said drive part and said inertial ring having a beveled edge juxtaposed to said accessory drive pulley.

5. An internal combustion engine accessory drive as set forth in claim 1, wherein the accessory drive pulley comprises a drive part rotatably affixed to the accessory drive shaft and an axially spaced pulley coupled to said drive part and said drive part having a beveled edge juxtaposed to the torsional damper.

6. An internal combustion engine accessory drive as set forth in claim 5, wherein the torsional damper comprises a drive part rotatably affixed to the crankshaft and an inertial ring elastically coupled to said drive part and said inertial ring having a beveled edge complimentary to and juxtaposed to the accessory drive pulley drive part beveled edge so that there is an axial overlap between said torsional damper and said accessory drive pulley.

7. An engine accessory drive as set forth in claim 6, wherein an oil pump is nested at lest in part within the accessory drive pulley within the pulley thereof and between the engine body one end and the accessory drive pulley drive part.

8. An engine accessory drive as set forth in claim 7, wherein the engine body one end is formed with a recess adjacent the one end of the crankshaft for clearing the accessory drive pulley and the oil pump.

* * * * *

UNITED STATES PATENT AND TRADEMARK OFFICE

CERTIFICATE OF CORRECTION

PATENT NO. : 6,186,109 B1
DATED : February 13, 2001
INVENTOR(S) : Yasuyuki Matsuno It is certified that error appears in the above-identified patent and that said Letters Patent is hereby corrected as shown below:

ABSTRACT,
Line 12, delete "case" and insert -- ease --.

Column 1,
Lines 13, 21, and 28, delete "arc" and insert -- are --.
Line 58, delete "shall" and insert -- shaft --.

Column 3,
Line 43, delete "gcar" and insert -- gear --.

Signed and Sealed this

Twenty-fifth Day of December, 2001

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,186,109 B1
DATED : February 13, 2001
INVENTOR(S) : Matsuno

It is certified that error appears in the above-identified patent and that said Letters Patent is hereby corrected as shown below:

Title page,
Item [30], Foreign Application Priority Data

November 18, 1998 (JP) …….. 10-327956

Signed and Sealed this

Ninth Day of July, 2002

*Attest:*

*Attesting Officer*

JAMES E. ROGAN
*Director of the United States Patent and Trademark Office*